US006135429A

United States Patent [19]

Woody

[11] Patent Number: 6,135,429

[45] Date of Patent: Oct. 24, 2000

[54] CARBURETOR WITH AUTOMATIC FUEL ENRICHMENT

[75] Inventor: John C. Woody, Caro, Mich.

[73] Assignee: Walbro Corporation, Cass City, Mich.

[21] Appl. No.: 09/185,692

[22] Filed: Nov. 4, 1998

[51] Int. Cl.[7] ..... F02M 17/04

[52] U.S. Cl. ..... 261/35; 261/DIG. 68

[58] Field of Search ..... 261/35, 69.1, 69.2, 261/DIG. 8, DIG. 38, DIG. 68, DIG. 39

[56] References Cited

U.S. PATENT DOCUMENTS

| | | | |
|---|---|---|---|
| 3,104,617 | 9/1963 | Barr | 261/35 X |
| 3,201,096 | 8/1965 | Barr | 261/35 X |
| 3,321,192 | 5/1967 | Phillips | 261/35 |
| 3,738,623 | 6/1973 | Tuckey | 261/DIG. 68 |
| 4,735,751 | 4/1988 | Guntly | 261/DIG. 8 |
| 4,770,822 | 9/1988 | Sejimo | 261/DIG. 68 |
| 4,814,114 | 3/1989 | Charmley | 261/35 |
| 4,903,655 | 2/1990 | Vonderau et al. | 261/35 X |
| 4,944,272 | 7/1990 | Carlsson et al. | 261/DIG. 68 |
| 5,133,905 | 7/1992 | Woody et al. | 261/35 |
| 5,241,931 | 9/1993 | Radel | 261/DIG. 68 |
| 5,262,092 | 11/1993 | Reeder et al. | 261/35 |
| 5,545,357 | 8/1996 | Radel et al. | 261/DIG. 8 |
| 5,720,906 | 2/1998 | Yamanaka et al. | 261/DIG. 68 |
| 5,743,240 | 4/1998 | Zerrer et al. | 261/35 X |
| 5,891,369 | 4/1999 | Tuggle et al. | 261/DIG. 8 |

*Primary Examiner*—Richard L. Chiesa
*Attorney, Agent, or Firm*—Reising, Ethington, Barnes, Kisselle, Learman & McCulloch, P.C.

[57] ABSTRACT

A carburetor having a fuel pump, a fuel metering diaphragm defining a fuel chamber on one side of the diaphragm and an air chamber on the opposite side of the diaphragm vented to the atmosphere, and a second diaphragm defining a first chamber on one side of the second diaphragm in communication with the carburetor fuel pump and a valve actuated by the second diaphragm to control the application of engine crankcase pressure pulses to the fuel metering diaphragm in response to the pressure at the carburetor fuel pump. The second diaphragm is yieldably biased to position the valve in a first position and upon cranking for initially starting the engine, pressure pulses from the engine crankcase are communicated to the air chamber of the fuel metering diaphragm. The pressure pulses from the engine crankcase act on the fuel metering diaphragm causing it to fluctuate and thereby increase the quantity of fuel mixed with the air flowing through the carburetor to facilitate staring the engine. After the engine is started and is running, the carburetor fuel pump output pressure increases and acts on the second diaphragm from within the first chamber to displace it and move the valve to its second position to prevent the pressure pulses from the engine crankcase from materially affecting the fuel metering diaphragm to permit conventional operation of the carburetor.

13 Claims, 6 Drawing Sheets

CARBURETOR WITH AUTOMATIC FUEL ENRICHMENT

FIELD OF THE INVENTION

This invention relates generally to carburetors and more particularly to a carburetor for providing an enriched fuel and air mixture during starting and warming up of an engine.

BACKGROUND OF THE INVENTION

Some current diaphragm-type carburetors utilize engine crankcase pressure pulses applied to the so-called dry side of a carburetor fuel control diaphragm to control or enrich the carburetor fuel and air mixture delivered to an engine during starting and warming up of the engine. The application of the engine crankcase pressure pulses in these current carburetors, such as disclosed in U.S. Pat. No. 4,814,114, is controlled by a manually operated, three-position valve. The valve has a fully closed position, a fully open position and an intermediate position between the fully closed and fully open positions.

To start an engine having this type of carburetor, air is purged from the carburetor, such as by depressing an air purge bulb, the throttle valve is moved to its fully opened or wide open throttle position and the three position valve is moved to its fully open position permitting engine crankcase pressure pulses to act on the fuel control diaphragm. The operator then tries to manually start the engine such as by pulling an engine starter rope or cord until engine combustion is initiated but not normally sustained and the engine stalls. The valve is then moved to its intermediate position decreasing the application of engine crankcase pressure pulses to the fuel control diaphragm. The operator continues to try and start the engine until the engine is started and operation of the engine is sustained. After a short period of time sufficient to allow the engine to warm up, the valve is turned to its fully closed position preventing the application of engine crankcase pressure pulses to the fuel control diaphragm. Starting an engine having a carburetor with this manual three-position choke valve can be difficult for unskilled operators who are unfamiliar with the multi-step engine starting process required with this type of carburetor. Further, the starting procedure has to be modified under different temperature conditions and the operator must have the knowledge and skill to employ the necessary starting procedure.

SUMMARY OF THE INVENTION

A carburetor having a fuel pump and a fuel metering diaphragm defining a fuel chamber on one side of the diaphragm and an air chamber on the opposite side of the diaphragm vented to the atmosphere has a second diaphragm defining a first chamber on one side of the second diaphragm in communication with the carburetor fuel pump and a valve carried by the second diaphragm to control the application of engine crankcase pressure pulses to the fuel metering diaphragm in response to the pressure at the carburetor fuel pump. The second diaphragm is yieldably biased to position the valve in a first open position and upon initially starting the engine, pressure pulses from the engine crankcase are communicated to the air chamber of the fuel metering diaphragm. The pressure pulses from the engine crankcase act on the fuel metering diaphragm causing it to fluctuate and thereby increase the quantity of fuel mixed with the air flowing through the carburetor to facilitate starting the engine. After the engine is started and is running, the carburetor fuel pump output pressure increases and acts on the second diaphragm from within the fuel chamber to displace it and move the valve to its second position to prevent the pressure pulses from the engine crankcase from materially affecting the fuel metering diaphragm to permit normal operation of the carburetor.

Thus, the pressure pulses from the engine crankcase act on the fuel metering diaphragm only during initial starting of the engine to provide an enriched fuel and air mixture from the carburetor to facilitate starting and warming up of the engine. The application and termination of the engine crankcase pulses to the fuel metering diaphragm are automatically controlled within the carburetor by the position of the valve to facilitate starting the engine and subsequent normal operation of the carburetor and engine.

Objects, features and advantages of this invention include providing a carburetor which provides engine crankcase pulses to a fuel metering diaphragm to provide an enriched fuel and air mixture to an engine to facilitate starting the engine, automatically terminates the application of the engine crankcase pulses to the fuel metering diaphragm when the engine is started, greatly facilitates starting the engine, eliminates the need for a three-position butterfly-type choke valve, is of relatively simple design and economical manufacture and assembly and in service, has a long useful life.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
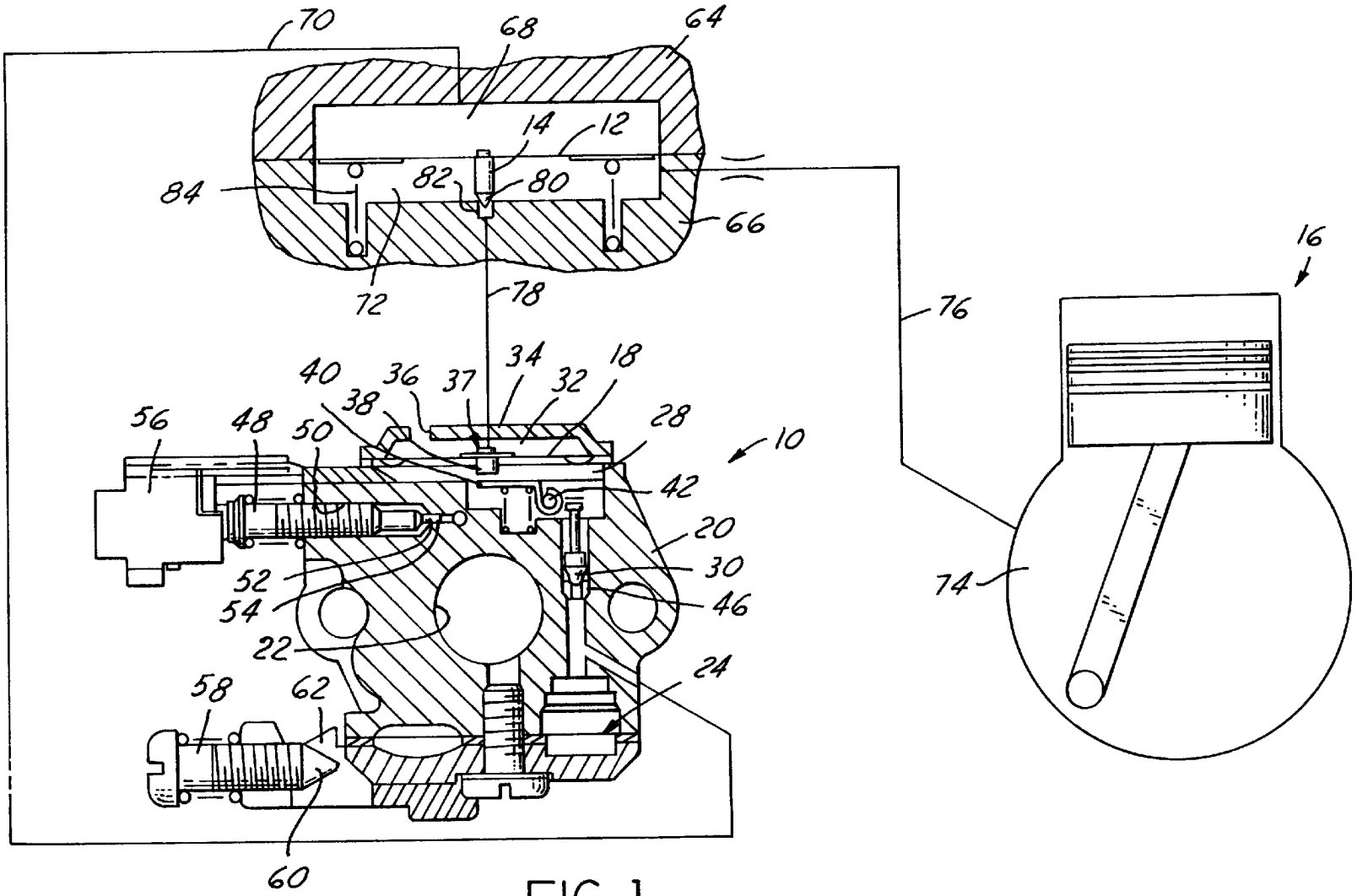
FIG. 1 is a diagrammatic view of a carburetor and engine having a pressure pulse control diaphragm and automatic pulse shut-off valve according to the present invention.

Referring in more detail to the drawings, FIG. 1 illustrates a carburetor 10 having a pressure pulse control diaphragm 12 and an automatic pulse shut-off valve 14 which automatically controls the application of engine crankcase pressure pulses during initial starting of an engine 16 to a fuel metering diaphragm 18 of the carburetor 10 to provide an enriched fuel and air mixture from the carburetor 10 to the engine 16 to facilitate starting the engine 16 and after the engine is started, to automatically terminate the application of the engine crankcase pressure pulses to the fuel metering diaphragm 18 for normal operation of the carburetor 10 and engine 16. The application and termination of the engine crankcase pulses to the fuel metering diaphragm 18 does not require any action by the operator and thereby greatly facilitates starting the engine 16 and thereafter, normal operation of the engine. The carburetor 10 as shown is ideally adapted for use with small two-stroke engines, such as are used with hand-held chain saws and lawn and gardening equipment, such as leaf blowers and weed trimmers.

The carburetor 10 has a main body 20 with a mixing passage 22 in which a throttle valve (not shown) is mounted to control the air flow through the mixing passage 22. A fuel pump 24 in the body 20 receives fuel from a fuel inlet (not shown) and delivers fuel to a fuel chamber 28 through an inlet valve 30 controlled by the fuel metering diaphragm 18. Generally, the fuel chamber 28 is defmed between one side of the metering diaphragm 18 and the main body 20 of the carburetor 10 and an air chamber 32 is defmed between the other side of the diaphragm 18 and a cover plate 34. Preferably, the air chamber 32 communicates with the atmosphere through a vent opening 36 in the cover plate 34. The fuel metering diaphragm 18 is responsive to a differential pressure across the diaphragm 18 to actuate a valve assembly 37 to control the delivery of fuel from the fuel pump 24 to the fuel chamber 28. The valve assembly 37 has a head 38 carried by the fuel metering diaphragm 18 and engageable with a lever 40 which rotates about a pivot pin 42 to move the valve 30 relative to a valve seat 46 to control the flow of fuel through the valve seat 46 into the fuel chamber 28 as disclosed in U.S. Pat. No. 5,262,092, the disclosure of which is incorporated herein by reference. The quantity of fuel delivered from the fuel chamber 28 to the mixing passage 22 is controlled by one or more needle valves 48 received in threaded bores 50 in the carburetor body 20 and rotatably adjustable to control the flow area between the needle valve head 52 and a valve seat 54 to thereby control the fuel flow rate through the needle valve assembly. A limiter cap 56 may be provided on the outboard end of the needle valve 48 to limit the adjustment of the needle valve 48 by a user. A conventional idle speed adjustment screw may 58 also be provided having a conical end 60 engageable with a lever 62 connected to a shaft on which the throttle valve is mounted to adjust the idle position of the throttle valve.

According to the present invention, a pressure pulse valve control diaphragm 12 is mounted between a pair of plates 64,66 and preferably carried by or attached to the carburetor body 20. The pressure pulse control diaphragm 12 defines a first chamber 68 on one side in communication with the carburetor fuel pump 24 to communicate the pressure at the carburetor fuel pump 24 to the control diaphragm 12 through a suitable passage as generally indicated by the conduit path 70 in FIG. 1. A second chamber 72 is defined on the opposite side of the pressure pulse control diaphragm 12 and is in communication with a crankcase chamber 74 of the engine 16 as indicated by conduit path 76, and with the air chamber 32 as indicated by conduit path 78 in FIG. 1. The automatic pulse shut-off valve 14 is preferably carried by the diaphragm 12 and has a valve head 80 with a conical tip engageable with a valve seat 82 to close the passage 78 and thereby prevent the application of the engine crankcase pressure pulses to the air chamber 32. Preferably, the diaphragm 12 is biased by a spring 84 to move the valve 14 to its open position with its valve head 80 spaced from the valve seat 82 and permitting communication between the air chamber 32 and the engine crankcase through the second chamber 72 and conduit path 78.

When initially cranking the engine for starting, there is relatively little pressure generated by the carburetor fuel pump 24 and thus there is little or no pressure within the first chamber 68 acting on the pressure pulse control diaphragm 12. The spring 84 biasing the control diaphragm 12 and the crankcase pressure pulses maintain the automatic pulse shut-off valve 14 in its open position such that pressure pulses from the engine crankcase 74 are communicated to the air chamber 32 adjacent the fuel metering diaphragm 18 through the second chamber 72 and the open valve 14. The pressure pulses in the air chamber 32 cause the fuel metering diaphragm 18 to fluctuate and provide an increased fuel flow into the fuel chamber 28 and subsequently into the mixing passage 22 to provide an enriched fuel and air mixture to the engine 16 to facilitate starting the engine 16. After the engine 16 is started, the pressure generated by the carburetor fuel pump 24 increases and is communicated to the first chamber 68 and acts on the control diaphragm 12 tending to displace it and thereby move the automatic pulse shut-off valve 14 to its closed position preventing communication between the engine crankcase 74 and the air chamber 32 to terminate the application of the engine crankcase pressure pulses to the fuel metering diaphragm 18 and permit the diaphragm 18 and the carburetor to function in their conventional manner.

Figure 2:
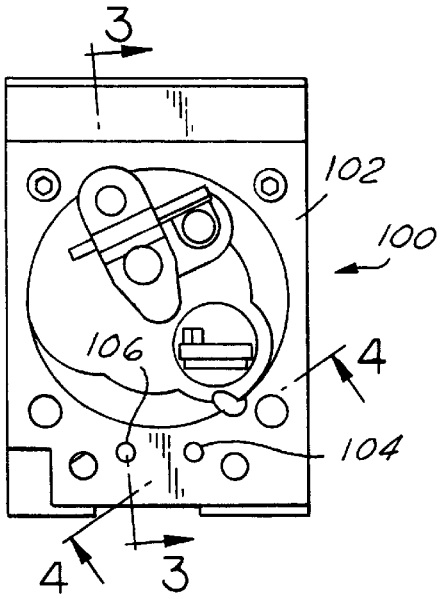
FIG. 2 is a top view of a carburetor of FIG. 1 with a pressure pulse control diaphragm assembly removed.
Figure 3:
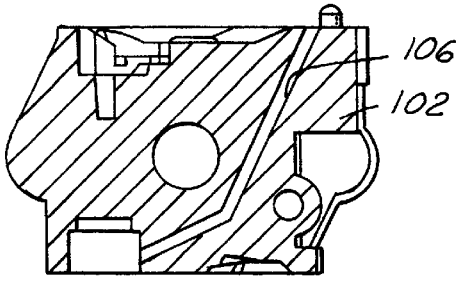
FIG. 3 is a cross-sectional view of the carburetor body taken generally along line 3—3 of FIG. 2.
Figure 4:
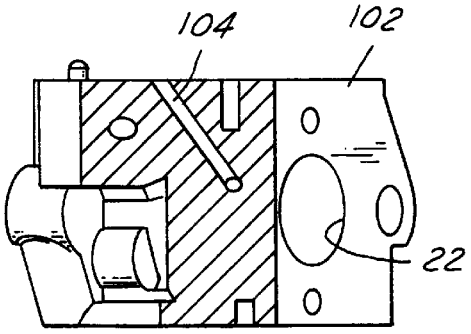
FIG. 4 is a cross-sectional view of the carburetor body taken generally along line 4—4 of FIG. 2.
Figure 5:
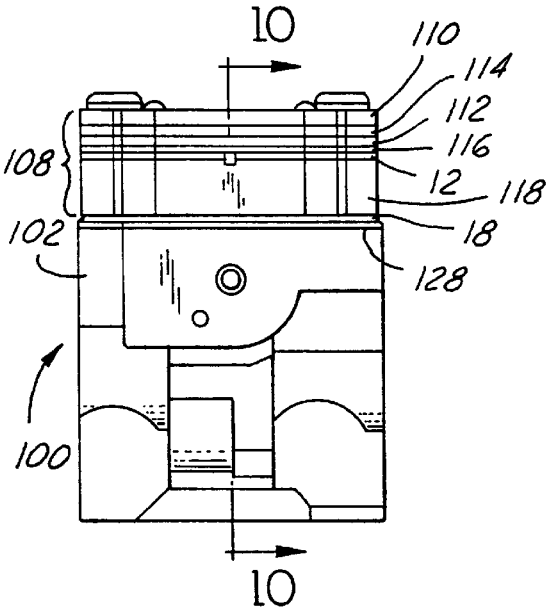
FIG. 5 is a side view of a carburetor according to a presently preferred embodiment of the invention.
Figure 6:
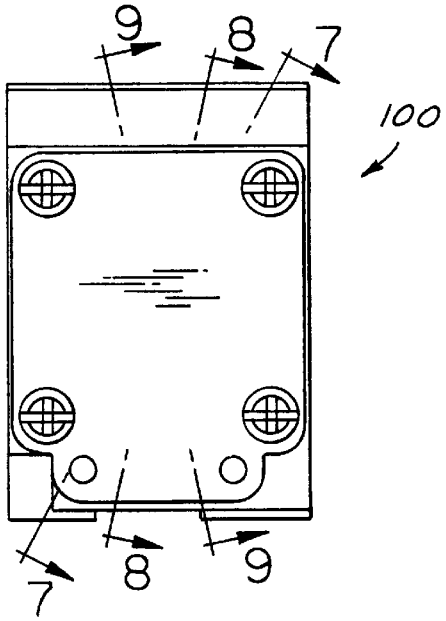
FIG. 6 is a top view of the carburetor of FIG. 5.
Figure 7:
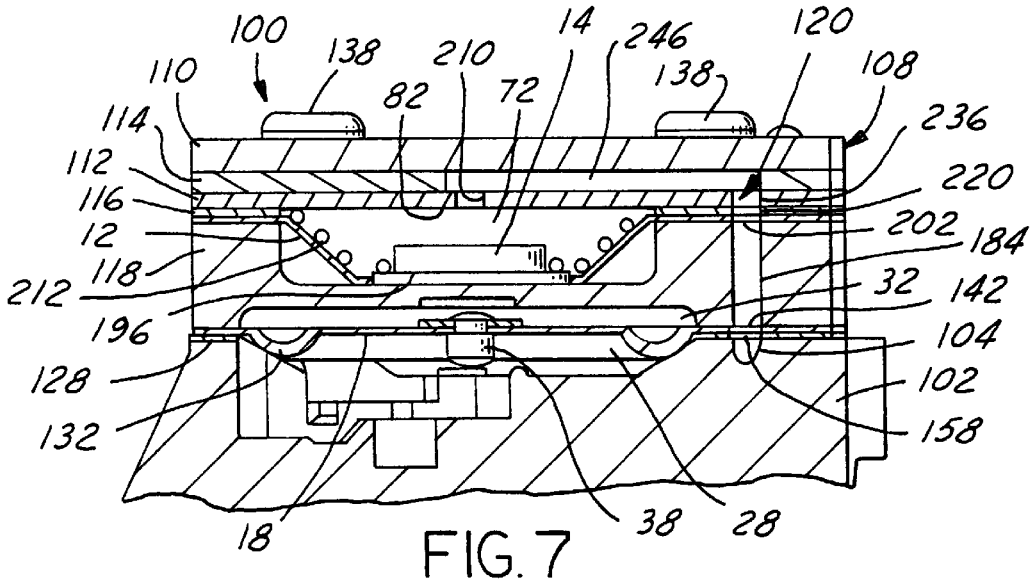
FIG. 7 is a fragmentary sectional view of the carburetor taken generally along line 7—7 of FIG. 6.
Figure 8:
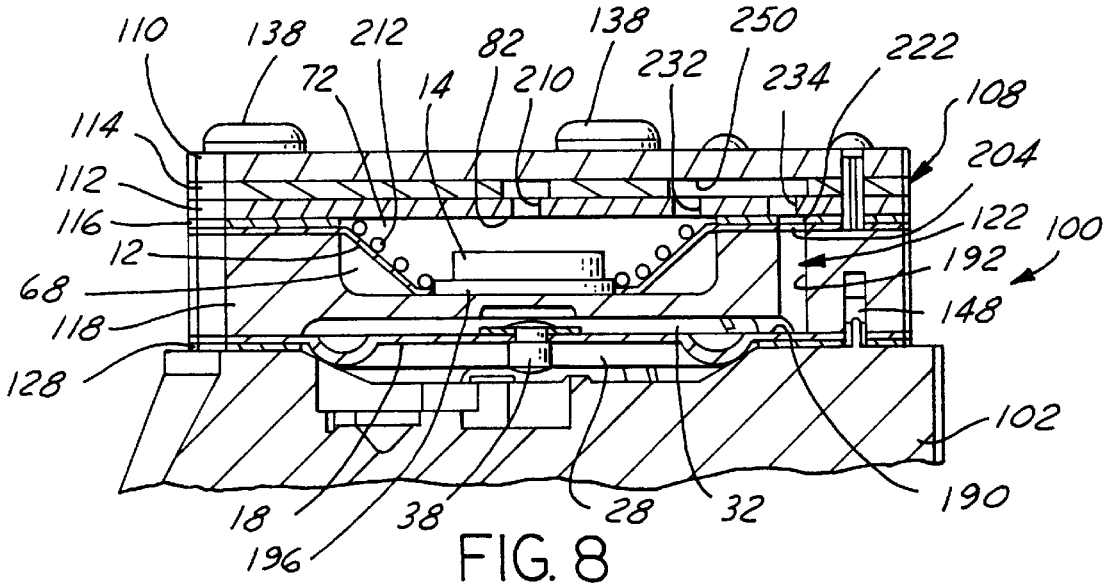
FIG. 8 is a fragmentary sectional view of the carburetor taken generally along line 8—8 of FIG. 6.

One specific embodiment of a carburetor 100 embodying this invention is illustrated in FIGS. 2–20. As shown in FIGS. 2–4, the carburetor 100 has a body 102 with a crankcase pressure passage 104 formed therein and communicating with the engine crankcase chamber 74 through a suitable passage. A fuel pump pressure passage 106 formed in the body 102 communicates at one end with the carburetor fuel pump 24.

As best shown in FIGS. 5–10, the pressure pulse control diaphragm 12 is mounted as part of an assembly 108 on the carburetor 100 adjacent to the fuel metering diaphragm 18. The assembly 108 preferably has a cover 110, an intermediate plate 112, a gasket 114 between the cover 110 and plate 112, a second gasket 116 between the plate 112 and control diaphragm 12, and a valve body 118 disposed between the fuel metering diaphragm 18 and the control diaphragm 12. As shown in FIGS. 7–10, the valve body 118 defines in part the air chamber 32 adjacent the fuel metering diaphragm 18 and the first chamber 68 adjacent the control diaphragm 12. Generally, a plurality of openings and slots formed in the various components of the assembly 108 define a passage 120 (FIG. 7) communicating the crankcase pressure passage 104 formed in the carburetor body 102 with the second chamber 72, other openings define a second passage 122 (FIG. 8) communicating the second chamber 72 with the air chamber 32, still other openings define a third passage 124 (FIG. 9) communicating the fuel pump pressure passage 106 in the carburetor body 102 with the first chamber 68, and still other openings define a vent passage 126 (FIG. 10) communicating the air chamber 32 with the atmosphere. Thus, with the assembly 108 mounted directly on the carburetor body 102, internal passages in the carburetor 100 and assembly 108 provide the desired pressure signals to the control diaphragm 12 to automatically control the application and termination of the engine crankcase pulses to the fuel metering diaphragm 18 to facilitate starting the engine 16 and to thereafter permit conventional operation of the carburetor 100 and engine 16.

Figure 11:
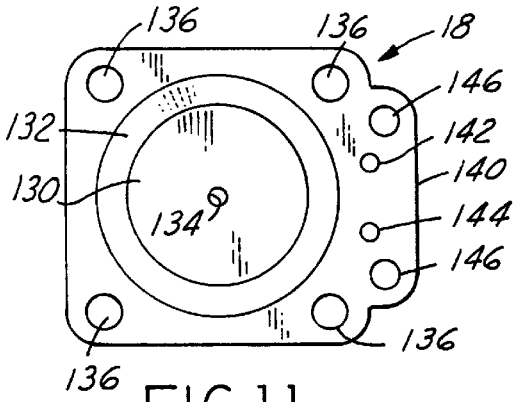
FIG. 11 is a top view of a fuel metering diaphragm of the carburetor.

The fuel metering diaphragm 18 is clamped about its periphery between the valve body 118 and a gasket 128 disposed between the fuel metering diaphragm 18 and the carburetor body 102 to provide a seal between them. As shown in FIG. 11, the fuel metering diaphragm 18 has a flexible central portion 130 and preferably has a circumferentially continuous bellows portion 132 to increase the flexibility of the diaphragm 18. A small central opening 134 through the central portion 130 of the diaphragm 18 is constructed to receive a portion of the plunger head 38. Four holes 136 generally equally spaced about the periphery of the diaphragm 18 are constructed to receive cap screws 138 which retain the assembly 108 on the carburetor body 102. An outwardly extending tab portion 140 of the diaphragm 18 provides an increased surface area through which an opening 142 is provided to define in part the passage 120 communicating the crankcase pressure passage 104 of the carburetor body 102 with the second chamber 72 and a second opening 144 which defines in part the third passage 124 communicating the fuel pump pressure passage 106 of the carburetor body 102 with the first chamber 68. A pair of additional openings 146 in this tab portion 140 of the diaphragm 18 are constructed to receive alignment pegs 148 (FIG. 8) extending from the carburetor body 102 to align the fuel metering diaphragm 18 with the carburetor body 102.

Figure 12:
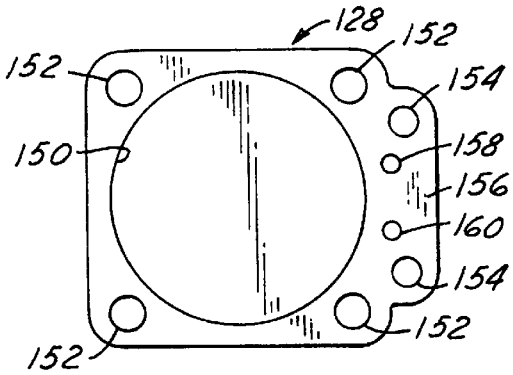
FIG. 12 is a top view of a gasket disposed between the fuel metering diaphragm and the carburetor body.

As best shown in FIGS. 7–10, the gasket 128 is disposed between the fuel metering diaphragm 18 and the carburetor body 102 to provide a seal between them. As shown in FIG. 12, this gasket 128 has a large central opening 150 to permit flexing of the fuel metering diaphragm 18 without interference by the gasket 128. Four generally equally spaced holes 152 receive the cap screws 138 in assembly and a pair of openings 154 in a tab portion 156 of the gasket 128 receive the alignment pegs 148 to align the gasket 128 relative to the carburetor body 102. A first opening 158 through the gasket 128 defines in part the passage 120 communicating the crankcase pressure passage 104 in the carburetor body 102 with the second chamber 72. A second opening 160 defines in part the third passage 124 communicating the fuel pump pressure passage 106 in the carburetor body 102 with the first chamber 68.

Figure 13:
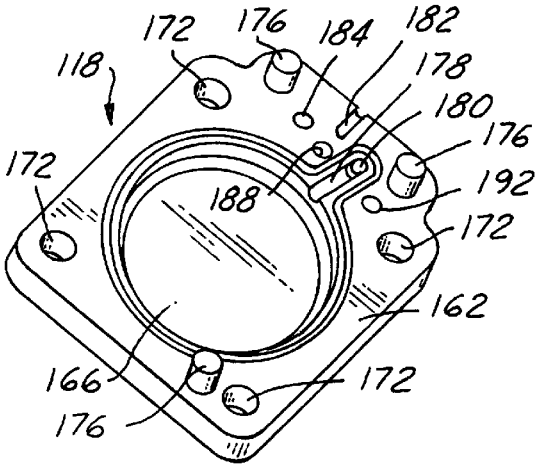
FIG. 13 is a top view of a valve body.
Figure 14:
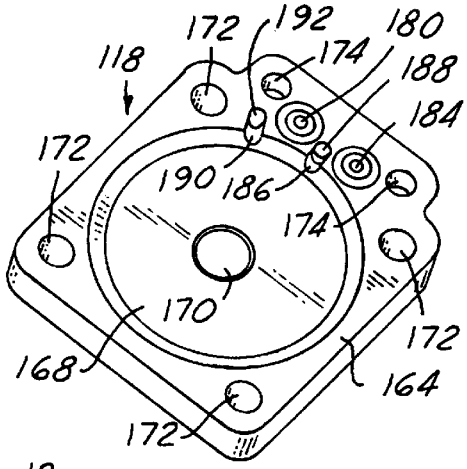
FIG. 14 is a bottom view of the valve body of FIG. 13.

As best shown in FIGS. 13 and 14, the valve body 118 has generally planar upper and lower faces 162,164, respectively, with a generally circular cavity 166 formed in its upper face 162 and defining in part the first chamber 68 and a generally circular cavity 168 formed in its lower face 164 and defining in part the air chamber 32. A small circular cavity 170 is formed in the cavity 168 in the lower face 164 of the valve body 118 to provide clearance for the plunger head 38 as it is displaced by the metering diaphragm 18. The valve body 118 is preferably formed of a plastic, such as an acetal polymer, and has a shape generally complementary to the fuel metering diaphragm 18 as well as the other components of the assembly 108 . Four generally equally spaced holes 172 receive the cap screws 138 and a pair of blind bores 174 formed in the lower face 164 of the valve body 118 receive the alignment pegs 148 extending from the carburetor body 102. Three spaced apart alignment pegs 176 extend from the upper face 162 of the valve body 118 to align the other components of the assembly 108 with the valve body 118. A first slot 178 formed in the upper face 162 of the valve body 118 communicates the cavity 166 formed in the upper face 162 with an opening 180 through the valve body 118 which defines in part the third passage 124 which communicates the fuel pump pressure passage 106 in the carburetor body 102 with the first chamber 68. A second slot 182 formed in the upper face 162 of the valve body 118 communicates with the atmosphere and defines in part the vent passage 126 which vents the air chamber 32 to the atmosphere. An opening 184 through the valve body 118 defines in part the passage 120 communicating the crankcase pressure passage 104 of the carburetor body 102 with the second chamber 72. A slot 186 formed in the lower face 164 of the valve body 118 communicates the air chamber 32 with an opening 188 through the valve body 118 which defines in part the vent passage 126 through the assembly 108 communicating the air chamber 32 with the atmosphere. Another slot 190 formed in the lower face 164 of the valve body 118 communicates the air chamber 32 with another opening 192 through the valve body 118 which defines in part the second passage 122 through the assembly 108 which communicates the second chamber 72 with the air chamber 32 when the valve 14 is in its open position.

Figure 15:
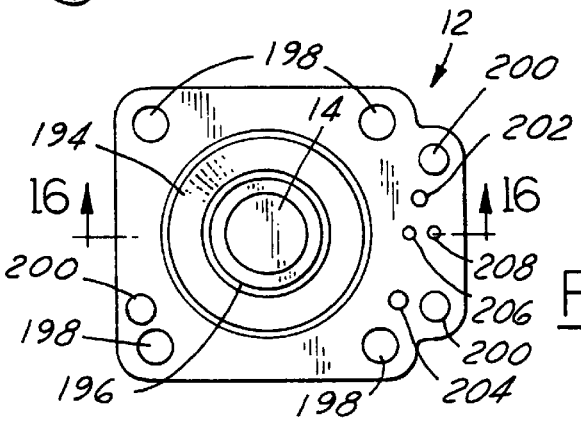
FIG. 15 is a top view of the pressure pulse control diaphragm.
Figure 16:
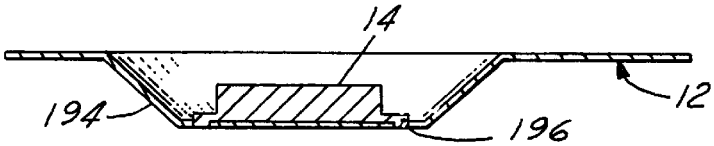
FIG. 16 is a cross-sectional view of the pressure pulse control diaphragm taken generally along line 16—16 of FIG. 15.

The control diaphragm 12 is preferably formed of a flexible polymeric material highly resistant to degradation by contact with fuel and, as best shown in FIGS. 15 and 16, has a generally cup-shaped, flexible central portion 194 to which a retainer 196 is bonded. The valve 14 in turn, is preferably bonded to the retainer 196. Four generally equally spaced holes 198 receive the cap screws 138 and three additional holes 200 are constructed to receive the alignment pegs 176 extending from the valve body 118 to align the diaphragm 12 with the valve body 118. An opening 202 through the diaphragm 12 defines in part the passage 120 communicating the crankcase pressure passage 104 in the carburetor body 102 with the second chamber 72. A second opening 204 through the diaphragm 12 defines in part the second passage 122 communicating the second chamber 72 with the air chamber 32. A pair of additional openings 206,208 through the diaphragm 12 define in part the vent passage 126 communicating the air chamber 32 with the atmosphere. The valve 14 is preferably formed of a suitable generally elastomeric material to provide a sufficient seal of a valve opening 210 in the intermediate plate 112 to prevent communication between the crankcase pressure passage 104 and the second chamber 72 when engaged with the valve seat 82. A coil spring 212 biases the diaphragm 12 and hence, the valve 14 to its open position and has one end bearing on the intermediate plate 112 and its other end bearing on the retainer 196 bonded to the diaphragm 12.

Figure 17:
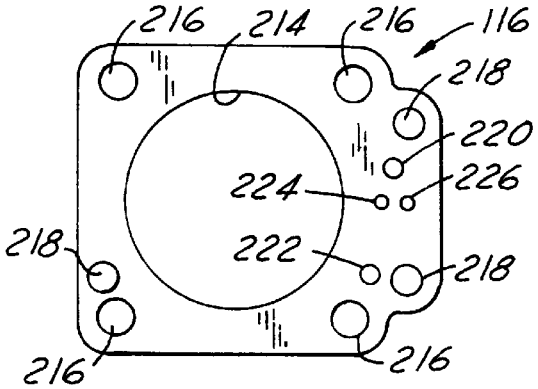
FIG. 17 is a top view of a gasket which overlies the pressure pulse control diaphragm in assembly of the carburetor.

As shown in FIG. 17, the second gasket 116 located between the control diaphragm 12 and the plate 112 preferably has a large central opening 214 to avoid interfering with the displacement of the diaphragm 12. The gasket 116 is preferably formed of a generally elastomeric material and is compressed between the plate 112 and the diaphragm 12 to provide a seal between them. Four generally equally spaced holes 216 receive the cap screws 138 and three additional openings 218 through the gasket 116 receive the alignment pegs 176 extending from the valve body 118. A first opening 220 through the gasket 116 defines in part the passage 120 communicating the crankcase pressure passage 104 in the carburetor body 102 with the second chamber 72. A second opening 222 through the gasket 116 defines in part the second passage 122 communicating the second chamber 72 with the air chamber 32. A pair of additional openings 224,226 through the gasket 116 define in part the vent passage 126 communicating the air chamber 32 with the atmosphere.

Figure 18:
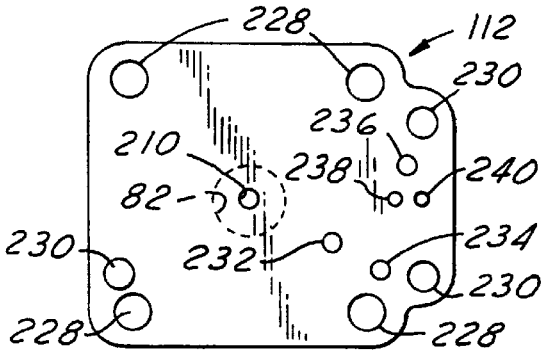
FIG. 18 is a top view of a valve plate of the carburetor.

The intermediate plate 112 is preferably formed of steel and, as best shown in FIG. 18, has four generally equal spaced holes 228 which receive the cap screws 138 and three additional holes 230 which receive the alignment pegs 176 extending from the valve body 118. The valve opening 210 with valve seat 82 is formed generally aligned with the valve 14 and defines in part the passage 120 communicating the crankcase pressure passage 104 of the carburetor body 102 with the second chamber 72 and is constructed to be selectively closed off by the valve. A second opening 232 through the plate 112 communicates directly with the second chamber 72 and defines in part the second passage 122 communicating the second chamber 72 with the air chamber 32. A third opening 234 through the plate 112 also defines in part the passage 122 communicating the second chamber 72 with the air chamber 32. A fourth opening 236 through the plate 112 defines in part the passage 120 communicating the crankcase pressure passage 104 of the carburetor body 102 with the second chamber 72. A pair of additional openings 238,240 through the plate 112 define in part the vent passage 126 communicating the air chamber 32 with the atmosphere.

Figure 19:
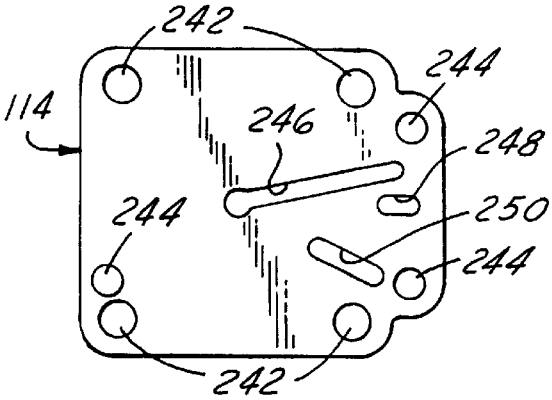
FIG. 19 is a top view of a gasket disposed between the valve plate and a cover of the carburetor in assembly.

The gasket 114 disposed between the plate 112 and the cover 110 is preferably formed of a generally elastomeric material and is compressed slightly between the cover 110 and plate 112 to provide a seal between them. As shown in FIG. 19, four generally equally spaced holes 242 through the gasket 114 are provided to receive the cap screws 138 and three additional holes 244 through the gasket 114 receive the alignment pegs 176 extending from the valve body 118. A first slot 246 formed through the gasket 114 communicates the valve opening 210 through the plate 112 with the fourth opening 236 through the plate 112 and defines in part the passage 120 communicating the crankcase pressure passage 104 in the carburetor body 102 with the second chamber 72. A second slot 248 formed through the gasket 114 communicates both of the openings 238 and 240 through the plate 112 and defines in part the vent passage 126 communicating the air chamber 32 with the atmosphere. A third slot 250 formed through the gasket 114 communicates the second and third openings 232,234 formed through the plate 112 and defines in part the second passage 122 communicating the second chamber 72 with the air chamber 32.

Figure 20:
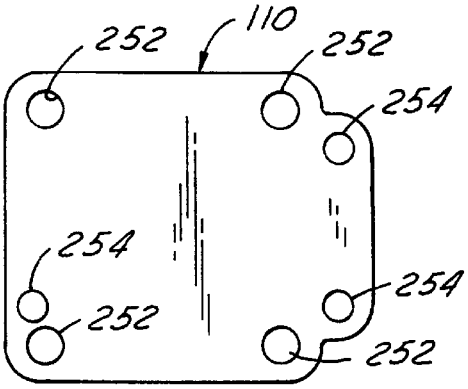
FIG. 20 is a top view of a cover of the carburetor.

The cover 110 is preferably formed of a generally flat piece of steel. As shown in FIG. 20, the cover 110 has four generally equally spaced holes 252 therethrough which receive the cap screws 138 and three additional holes 254 which receive the alignment pegs 176 extending from the valve body 118.

Operation

To start an engine 16 having a carburetor 100 embodying this invention, an operator simply cranks the engine such as by manually pulling a starter rope to initially crank the engine 16. Pressure pulses from the engine crankcase 74 are communicated with the crankcase pressure passage 104 formed in the carburetor body 102. The crankcase pressure passage 104 in the carburetor body 102 is communicated with the second chamber 72 through the passage 120 shown in FIG. 7. This passage 120 includes openings 158, 142, 184, 202, 220, 236 through the gasket 128, fuel metering diaphragm 18, valve body 118, control diaphragm 16, gasket 116, and the plate 112, and also includes the first slot 246 through the gasket 114 and the valve opening 210 through the plate 112. The spring 212 biasing the control diaphragm 12 initially holds the valve 14 in its open position against the pressure within the first chamber 68. When the valve 14 is in its open position, the passage 120 is communicated with the second chamber 72 which in turn is communicated with the air chamber 32 through the second passage 122 shown in FIG. 8. The second passage 122 extends from the second chamber 72 through the second opening 232 in the plate 112, the third slot 250 through the gasket 114, and then through successive openings 234, 222, 204, 192 in the plate 112, gasket 116 control diaphragm 12 and the valve body 118 which through the slot 190 formed in the lower face 164 of the valve body 118 communicates with the air chamber 32. Thus, the engine crankcase pulses are communicated with the second chamber 72 through the passage 120 shown in FIG. 7 which in turn are communicated with the air chamber 32 through the second passage 122 shown in FIG. 8 to apply the engine crankcase pressure pulses to the fuel metering diaphragm 18 during initial starting of the engine 16.

Figure 9:
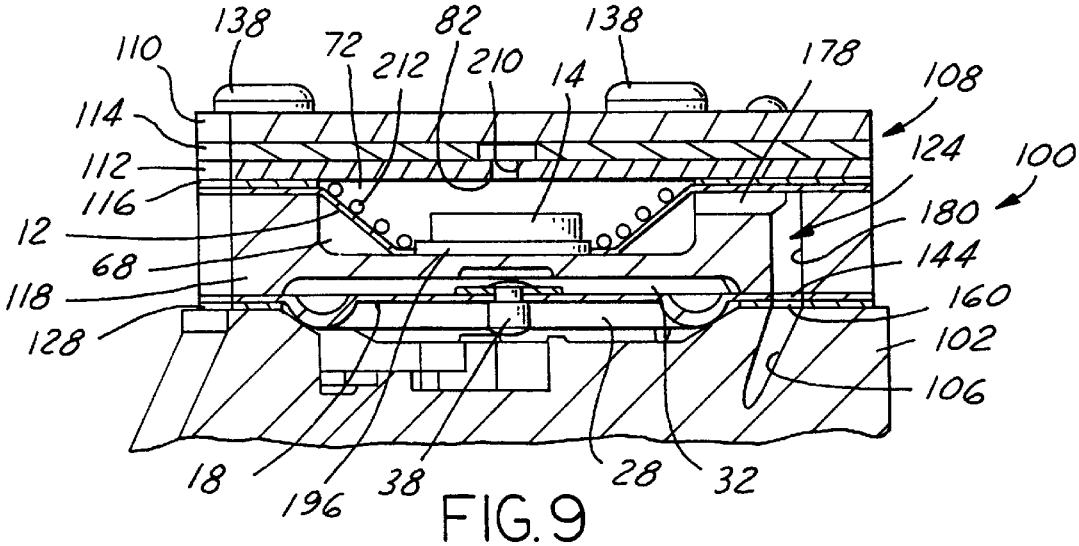
FIG. 9 is a fragmentary sectional view of the carburetor taken generally along line 9—9 of FIG. 6.

After the engine 16 is started, the carburetor fuel pump 24 pressure increases. The fuel pump pressure is communicated to the first chamber 68 through the fuel pump pressure passage 106 formed in a carburetor body 102 and the third passage 124 through the assembly 108 as shown in FIG. 9. Generally, this passage 124 extends through successive openings 160, 144, 180 in the gasket 128, the fuel metering diaphragm 18 and the valve body 118 which communicates with the first chamber 68 through the slot 178 formed in the upper face 162 of the valve body 118. When the force of the fuel pump pressure communicated to the first chamber 68 is greater than the force of the spring 212 biasing the control diaphragm 12 and the control diaphragm's 12 own resistance to displacement, the control diaphragm 12 is displaced until the valve 14 engages the seat 82 on the plate 112 thereby closing off the valve opening 210 to prevent the engine crankcase pressure pulses from entering the second chamber 72. Thus, with the valve 14 in its closed position, the crankcase pressure pulses are not communicated with the air chamber 32 and the carburetor 100 functions conventionally with the air chamber 32 vented to the atmosphere through the vent passage 126 shown in FIG. 10.

Figure 10:
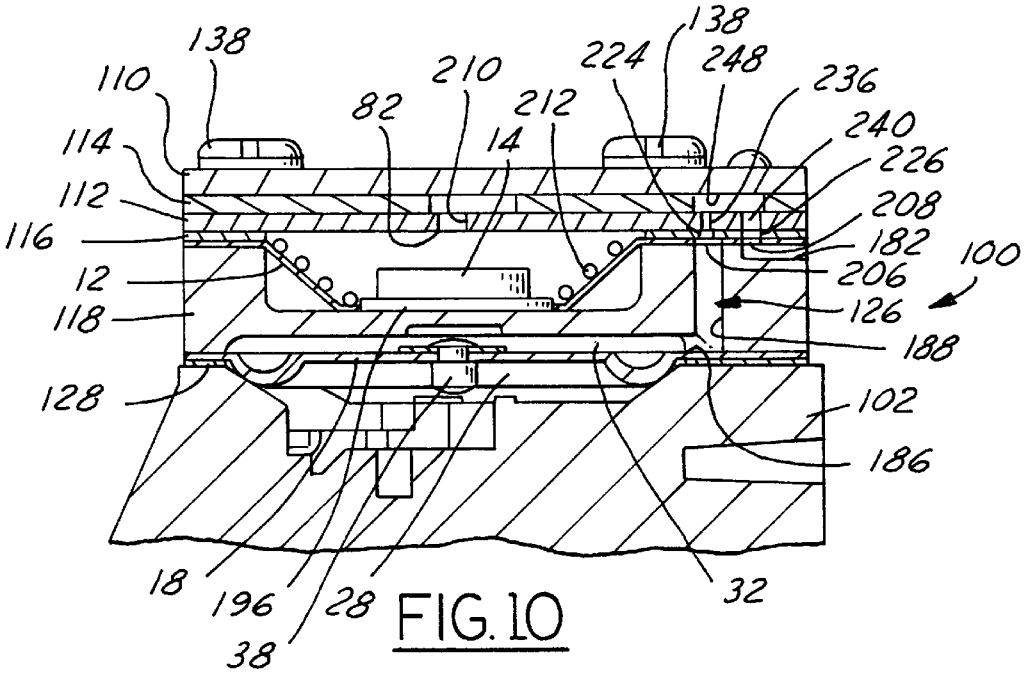
FIG. 10 is a fragmentary sectional view of the carburetor taken generally long line 10—10 of FIG. 5.

As shown in FIG. 10, during operation of the carburetor 100 the air chamber 32 is open to the atmosphere through the vent passage 126. Generally, the vent passage 126 includes the slot 186 formed in the lower face 164 of the valve body 118 which communicates the air chamber 32 with the opening 188 through the valve body 118 and the successive openings 206, 224, 238 through the control diaphragm 12, gasket 116, and plate 112 which lead to the second slot 248 through the gasket 114. This slot 248 communicates these openings 206, 224, 238 with the other openings 208, 226, 240 through the control diaphragm 12, gasket 116 and plate 112 providing a convoluted path which opens into the second slot 182 formed in the upper face 162 of the valve body 118 which is open to the atmosphere. This relatively convoluted vent passage 126 has a relatively small diameter and is constructed to prevent the crankcase pressure pulses communicated with the air chamber 32 from being excessively diluted by this vent to the atmosphere. Openings 238 and/or 240 in plate 112 can also be sized to provide further restriction. This enables the crankcase pressure pulses to effect movement of the fuel metering diaphragm 18 sufficient to cause an enriched fuel supply to the mixing passage 22 to provide an enriched fuel and air mixture to the operating engine 16 to facilitate starting the engine 16.

Second Embodiment

Figure 21:
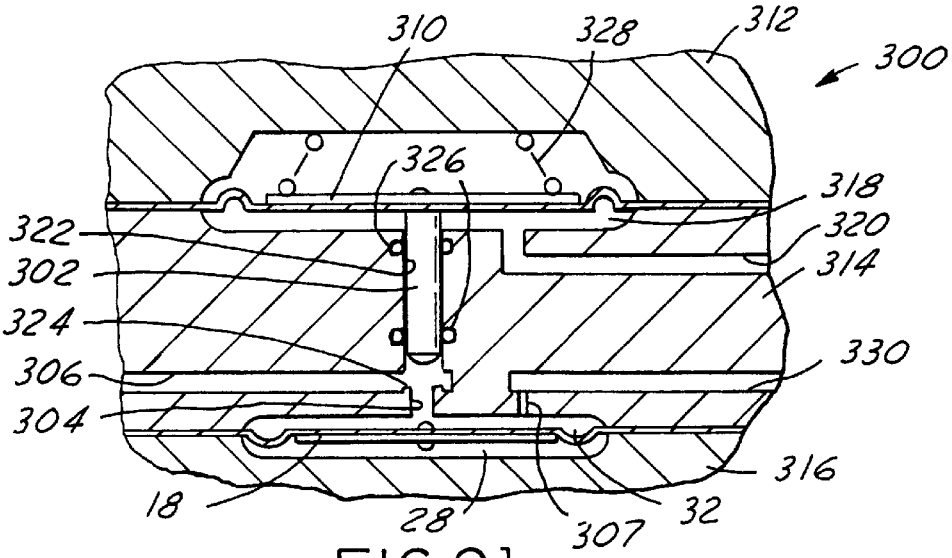
FIG. 21 is a diagrammatic view of an alternate embodiment of a carburetor embodying this invention.

As shown in FIG. 21, a second embodiment of a carburetor 300 embodying this invention has a valve 302 movable between first and second positions to selectively communicate a vent opening 304 of the air chamber 32 with the atmosphere through a vent passage 306. The vent opening 304 is of a relatively large size and is sufficiently larger than a restricted portion 307 of a crankcase pressure passage 330 which communicates engine crankcase pressure pulses with the air chamber 32 such that when the vent opening 304 is open to the atmosphere, any engine crankcase pressure pulses communicated to the air chamber 32 are severely dissipated to prevent such pulses from significantly affecting the fuel metering diaphragm 18. Preferably, the flow area of the vent opening 304 is on the order of 5 to 100 times greater than the flow area of the restricted portion 307 of the crankcase pressure passage 330.

The valve 302 is operably connected to a second diaphragm 310 which is clamped about its periphery between a cover 312 and an intermediate plate 314 both of which are bolted to or otherwise carried by the carburetor body 316. The second diaphragm 310 defines in part a first chamber 318 on one side of the diaphragm which communicates with the carburetor fuel pump 24 through a first passage 320.

The valve 302 preferably extends into an opening 322 through the plate 314 and is engageable with a valve seat 324 defmed by the plate 314. Sealing members 326 such as O-rings prevent leakage from the first chamber 318 through the vent passages. A spring 328 received between the cover 312 and the other side of the second diaphragm 310 yieldably biases the second diaphragm 310 and hence, the valve 302 to a first position bearing on the valve seat 324 and closing the vent opening 304.

The fuel metering diaphragm 18, constructed to function substantially the same as in the first embodiment carburetor 10,100 is clamped about its periphery between the intermediate plate 314 and the carburetor body 316. A crankcase pressure passage 330 is constructed to communicate an engine crankcase chamber with the air chamber 32 and is always open.

Operation of Second Embodiment

Before and upon initially cranking and starting the engine the valve 302 is in its first position closing the vent opening 304. Thus, engine crankcase pressure pulses are communicated with the air chamber 32 through the crankcase pressure passage 330 to cause movement of the fuel metering diaphragm 18 and a resulting enriched fuel and air mixture delivered to the engine to facilitate starting and initial warming up of the engine.

After the engine is started, the increasing pressure generated by the carburetor fuel pump 24 is communicated with the first chamber 318 through the first passage 320. When the force on the second diaphragm 310 of the pressure in the first chamber 318 is greater than the force of the spring 328 and the second diaphragm's own resistance to displacement, the diaphragm 310 is displaced and the valve 302 is disengaged from the valve seat 324 to open the vent opening 304. With the air chamber 32 vented to the atmosphere through the relatively large vent opening 304, the engine crankcase pressure pulses are severely dissipated and do not materially affect the fuel metering diaphragm 18. Thus, the fuel metering diaphragm 18 functions as if there are no engine crankcase pressure pulses being applied to it to permit conventional operation of the carburetor 300 while the engine is running.

Thus, the carburetor 10,100,300 according to this invention greatly facilitates starting an engine and particularly a two-stroke engine. The conventional manual three-position choke valve or manual crankcase pulse control valve is eliminated and the engine crankcase pressure pulses are automatically applied to the fuel metering diaphragm 18 to provide an enriched fuel and air mixture to facilitate starting the engine 16. After the engine 16 is started, the carburetor 10,100,300 automatically terminates or diminishes the application of the engine crankcase pressure pulses to the fuel metering diaphragm 18 to permit the carburetor 10,100, 300 to function conventionally while the engine is running normally. Advantageously, this application and termination of the engine crankcase pulses to the fuel metering diaphragm 18 does not require any operator skill or intervention.

What is claimed is:

1. A carburetor for providing a fuel and air mixture to an engine, comprising:

a body;

a fuel metering diaphragm carried by the body and having two generally opposed sides and defining in part an air chamber on one side and a fuel chamber on its other side;

a first fuel metering valve actuated by the fuel metering diaphragm;

a fuel pump carried by the body and constructed to draw fuel from a supply tank and deliver fuel under pressure to the fuel chamber;

a first passage communicating with the fuel pump;

a second passage communicating with the air chamber and constructed to be in communication with a crankcase chamber of an engine; and a second valve movable between first and second positions and responsive to the pressure within the first passage generated by the fuel pump to move from its first position towards its second position when the pressure at the fuel pump is above a threshold pressure to prevent engine crankcase pressure pulses from materially affecting the pressure within the air chamber and acting on the fuel metering diaphragm, said second valve being open in one of said first and second positions and closed in the other of said first and second positions.

2. The carburetor of claim 1 wherein the second valve is disposed in the second passage and permits fluid flow into the air chamber from the second passage when in its first position and substantially prevents fluid flow into the air chamber from the second passage when in its second position.

3. The carburetor of claim 1 which also comprises a vent opening communicating the air chamber with the atmosphere, the vent opening is of sufficient size to maintain the pressure in the air chamber substantially at atmospheric pressure when open even when engine crankcase pressure pulses are communicated to the air chamber through the second passage and the second valve closes the vent opening when in its first position so that the engine crankcase pressure pulses are not vented to the atmosphere through the vent opening and act on the fuel metering diaphragm.

4. The carburetor of claim 1 which also comprises a pressure pulse control diaphragm which actuates the second valve, has a pair of opposed sides and which defines in part a first chamber on one side in communication with the fuel pump through the first passage, the control diaphragm is responsive to the pressure within the first chamber to move the second valve to its second position when a sufficient pressure exists in the first chamber.

5. The carburetor of claim 4 wherein the pressure pulse control diaphragm also defines in part a second chamber on its other side constructed to communicate with the crankcase chamber of the engine and with the air chamber and the second valve substantially prevents communication between the second chamber and the air chamber when in its second position.

6. The carburetor of claim 1 wherein the first passage is in the body.

7. The carburetor of claim 4 wherein the pressure pulse control diaphragm is carried by the body.

8. The carburetor of claim 4 wherein the pressure pulse control diaphragm is yieldably biased by a spring to yieldably bias the second valve to its open position.

9. The carburetor of claim 4 which also comprises an assembly mounted on the body, the assembly comprises the pressure pulse control diaphragm, a valve body disposed between the fuel metering diaphragm and the pressure pulse control diaphragm and defining in part the air chamber on one side and the first chamber on its other side, a cover enclosing the second chamber, and the first and second passages are formed in part in the assembly.

10. The carburetor of claim 9 which also comprises a vent passage formed through the assembly communicating the air chamber with the atmosphere.

11. A carburetor for providing a fuel and air mixture to an engine, comprising:

a body;

a fuel metering diaphragm carried by the body and having two generally opposed sides and defining in part an air chamber on one side and a fuel chamber on its other side;

a first fuel metering valve actuated by the fuel metering diaphragm;

a fuel pump carried by the body and constructed to draw fuel from a supply tank and deliver fuel under pressure to the fuel chamber;

a first passage communicating with the fuel pump;

a second passage communicating with the air chamber and constructed to be in communication with a crankcase chamber of an engine; and a second valve disposed in the second passage and movable between a first position permitting fluid flow into the air chamber from the second passage and a second position substantially preventing fluid flow into the air chamber from the second passage and responsive to the pressure within the first passage generated by the fuel pump to move from its first position towards its second position when the pressure at the fuel pump is above a threshold pressure to prevent engine crankcase pressure pulses from materially affecting the pressure within the air chamber and acting on the fuel metering diaphragm.

12. A carburetor for providing a fuel and air mixture to an engine, comprising:

a body;

a fuel metering diaphragm carried by the body and having two generally opposed sides and defining in part an air chamber on one side and a fuel chamber on its other side;

a first fuel metering valve actuated by the fuel metering diaphragm;

a fuel pump carried by the body and constructed to draw fuel from a supply tank and deliver fuel under pressure to the fuel chamber;

a first passage communicating with the fuel pump;

a second passage communicating with the air chamber and constructed to be in communication with a crankcase chamber of an engine;

a vent opening communicating the air chamber with the atmosphere; and a second valve movable between a first position closing the vent opening, and a second position spaced from the vent opening, the second valve is responsive to the pressure within the first passage generated by the fuel pump to move from its first position towards its second position when the pressure at the fuel pump is above a threshold pressure, the vent opening is of sufficient size to maintain the pressure in the air chamber substantially at atmospheric pressure when the second valve is in the second position even when engine crankcase pressure pulses are communicated to the air chamber through the second passage and the second valve closes the vent opening when in its first position so that the engine crankcase pressure pulses are not vented to the atmosphere through the vent opening and act on the fuel metering diaphragm.

13. The carburetor of claim 12 wherein the flow area of the vent opening is between 5 and 100 times larger than the flow area of a restricted portion of the second passage.

* * * * *

UNITED STATES PATENT AND TRADEMARK OFFICE

CERTIFICATE OF CORRECTION

PATENT NO. : 6,135,429
DATED : October 24, 2000
INVENTOR(S) : John C. Woody

It is certified that error appears in the above-identified patent and that said Letters Patent is hereby corrected as shown below:

IN THE DRAWINGS

FIG. 6:

Please correct the section lines in this figure as follows:

Change section line "7-7" to -- 8-8 --

Change section line "8-8" to -- 9-9 --.

Change section line "9-9" to -- 7-7 --.

FIG. 10:

Please change reference character "236" to -- 238 --.

Signed and Sealed this

Eighth Day of May, 2001

*Attest:*

Nicholas P. Godici

NICHOLAS P. GODICI

*Attesting Officer*

*Acting Director of the United States Patent and Trademark Office*